US007913347B2

(12) United States Patent
Wong

(10) Patent No.: US 7,913,347 B2
(45) Date of Patent: Mar. 29, 2011

(54) ROTATIONAL TOOTHBRUSH

(76) Inventor: Hing Wing Wong, Hong Kong (HK)

( * ) Notice: Subject to any disclaimer, the term of this patent is extended or adjusted under 35 U.S.C. 154(b) by 129 days.

(21) Appl. No.: 12/456,233

(22) Filed: Jun. 15, 2009

(65) Prior Publication Data

US 2010/0313372 A1 Dec. 16, 2010

(51) Int. Cl.
*A46B 7/02* (2006.01)

(52) U.S. Cl. ..... 15/172; 15/144.1; 15/144.2; 15/167.1

(58) Field of Classification Search ..... 15/144.1, 15/144.2, 167.1, 172; D4/104, 109
See application file for complete search history.

(56) References Cited

U.S. PATENT DOCUMENTS

| | | | | | |
|---|---|---|---|---|---|
| 1,172,109 | A * | 2/1916 | Cammack | ..... | 15/172 |
| 1,439,914 | A * | 12/1922 | Saxe | ..... | 15/172 |
| 1,779,057 | A * | 10/1930 | Tolmach | ..... | 403/68 |
| 2,280,165 | A * | 4/1942 | Sebastian | ..... | 403/94 |
| 2,887,710 | A * | 5/1959 | Mahoney | ..... | 15/172 |
| 4,403,623 | A * | 9/1983 | Mark | ..... | 15/167.1 |
| 4,727,618 | A * | 3/1988 | Mahoney | ..... | 15/172 |
| 2007/0283519 | A1 * | 12/2007 | Moss | ..... | 15/167.1 |

* cited by examiner

*Primary Examiner* — Mark Spisich

(57) ABSTRACT

A toothbrush which head can be rotated to form different angle with the handle. This action of rotation can be done while brushing the teeth, once the handle leaves out the slot at the head, the handle can be moved to another slot, the angle of the head and the handle is changed from 180 degree to 90 degree and then from 90 to 180 degree again. The handle also can be free rotated without fixing to the slot at the head. A T-shape shaft is inserted between two covers at the head of the toothbrush, a connector is connected between the T-shape shaft and the handle of the toothbrush, so that the head and handle can be rotated freely.

1 Claim, 3 Drawing Sheets

Fig. 1a
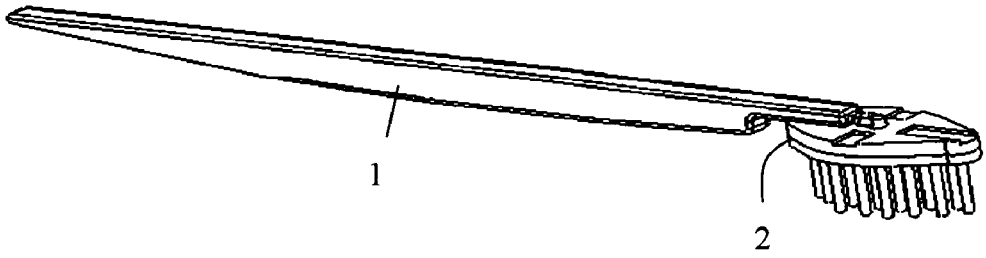
Fig. 1b
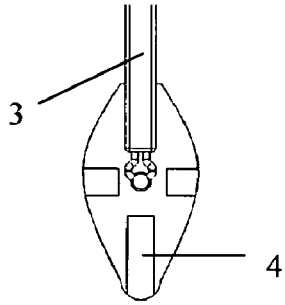
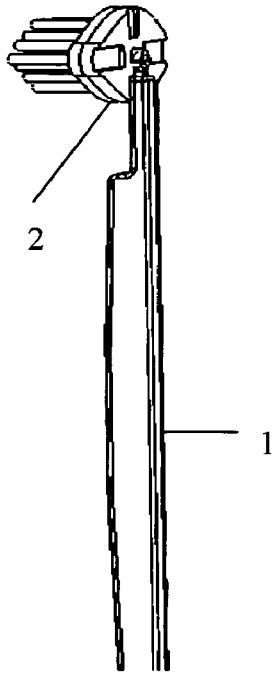
Fig.2

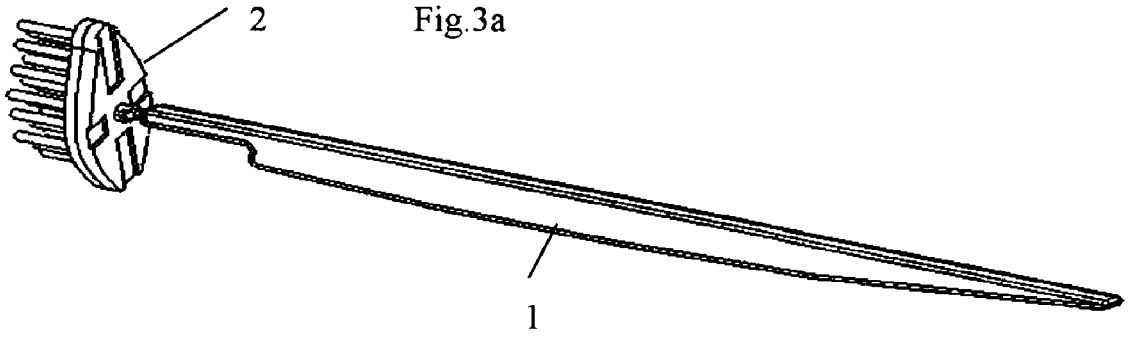
Fig.3a
Fig.3b
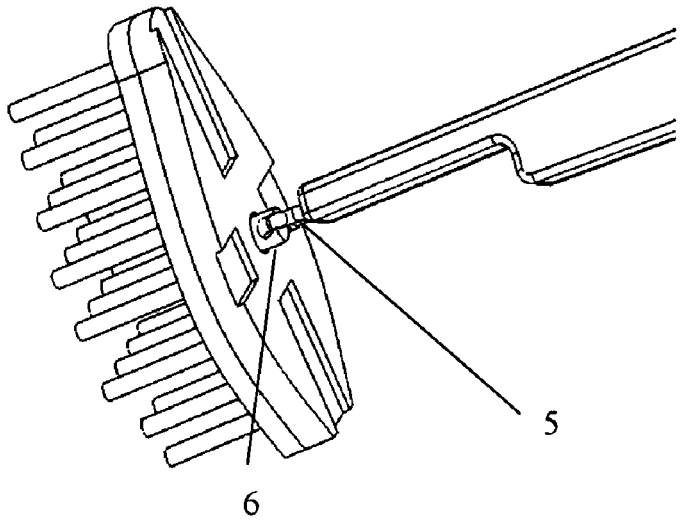

Fig.4
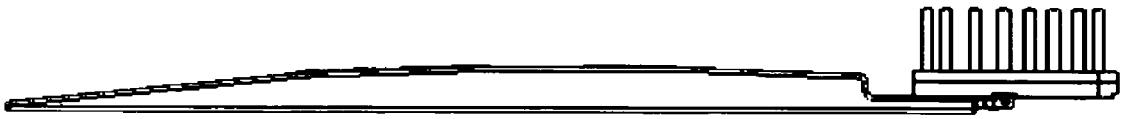
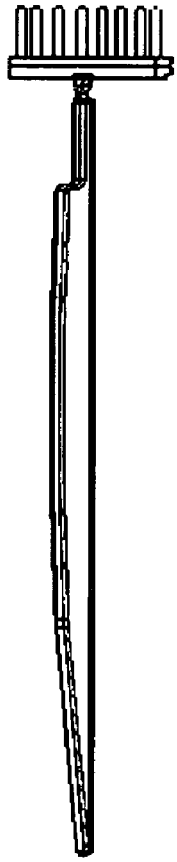
Fig. 5

ROTATIONAL TOOTHBRUSH

CROSS-REFERENCE TO RELATED APPLICATIONS

Not Applicable

STATEMENT REGARDING FEDERALLY SPONSORED RESEARCH OF DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The brush head of existing toothbrushes in the market are all structured in one direction and fixed to the handle. We can brush our teeth in right and left direction easily, but if we want to brush our teeth up and down or in circular direction, our hand needs more effort to do that because we cannot apply the force to the toothbrush correctly, this will make our hand uncomfortable and easy to get tired and the residue in crevice between the teeth can not be cleaned out easily too. Therefore, we need to invent a new toothbrush that can make us apply the force to the toothbrush easily when we are brushing our teeth in different directions, so that our hand will not get tired easily and make our teeth cleaner.

BRIEF SUMMARY OF THE INVENTION

If we can rotate toothbrush head in different directions when we are brushing our teeth, we can apply our force to the toothbrush correctly and easily, our hand will not get tired and our teeth will be cleaner, the brushes even can be like many toothpicks to clean out the residue in crevice between the teeth.

The structure of the brush head will be changed completely, there is a rotational joint at the head, the handle will be connected to the joint, so that when we are brushing our teeth, we can rotate the brush head in different directions easily. There are four slots at the head cover surface, the handle can be fixed to the head or not when one direction is changed. For example, we can rotate the head in a position that is perpendicular to the handle, the slot will make the handle fix to the head, so that we can apply the force to the toothbrush correctly, our hand will not get tired easily and our teeth will be cleaner. The head can be even rotated freely and the brush will be like many toothpicks, we can brush the residue at our teeth out more easily, our hand will not get tired too because we apply the force to the toothbrush in the right direction.

BRIEF DESCRIPTION OF THE SEVERAL VIEWS OF THE DRAWING

The invention can be explained in details by several views of drawing. The head is rotated to different positions so that the brush can be performed the different functions.

The drawings show:

FIG. 1*a* shows the normal position of the head so that it just likes a normal toothbrush. 1 is the handle and 2 is the head.

FIG. 1*b* shows the head, there are four slots, when the head is rotated to different position, 3 can be fixed to 4, so that the handle will be fixed to the head while brushing. 3 can be moved out from the slot when the user wants to rotate the head.

FIG. 2 shows the head is rotated to the position so that 1 is perpendicular to 2. The user can brush the teeth in vertical direction.

FIG. 3*a* shows another position of the head rotated so that 1 and 2 is formed like a "T". At this time, the brush is like many toothpicks, the user can clean his/her teeth in different ways.

FIG. 3*b* shows the connector between the handle and the head. 5 is connected to 6, 6 is a T-shaft so that it will not move out from the head but can be rotated freely. 5 is fixed to the handle, so that the head can be rotated to different position.

FIG. 4 shows the side view of the brush when the head is at normal position.

FIG. 5 shows the side view of the brush when the head is rotated.

DETAILED DESCRIPTION OF THE INVENTION

The brush of this invention can be used as normal brush to clean the teeth, but when the handle leaves out the slot at the head, the head can be rotated. After the head is rotated to a new position, the handle can be fixed to another slot at the head; the user can brush the teeth in different directions.

There are 5 directions the user can brush the teeth. First, just like a normal brush, the handle is same direction to the head; the angle is 180 degree as a straight line. Second, the handle can be moved to next slot, so that the handle is perpendicular to the head, their angle is 90 degree, the user can brush the teeth in vertical direction that can clean the teeth more easily because the user can apply force to the handle correctly. The vertical direction also can brush the teeth cleaner, the user can move out the crevice between the teeth easier. Third, the handle can be moved to next slot, the head and the handle is located in same direction and 180 degree angle again, this direction is good for left hand user who can apply the force easier. Fourth, the handle leaves out the slot again and moved to final slot, this time the handle is perpendicular the head again. The final position is the handle that is not fixed to any slots, the handle and the head is formed like a "T" shape, just like many toothpicks, the user can move out the crevice between the teeth much easier. All these 5 directions can make the users clean their teeth easier and apply the force the handle in correct ways and also suitable for right-hand and left-handle user.

The structure of the invention is look like a normal toothbrush, but there is T-shape shaft at the middle of the head, there is connector fixed to the T-shape shaft and the handle, so that the handle can rotate freely but the head will not be dropped out.

The invention claimed is:

1. A toothbrush comprising:

an elongate brush head having a top surface and a bottom surface, the bottom surface having a plurality of bristles extending therefrom, a generally central portion of the top surface having a coupling shaft member; said top surface further including a first pair of elongate slots at opposed ends of the head and generally aligned with the longitudinal axis of the head with the coupling shaft member between them and a second pair of elongate slots at transverse side portions of the head, the second pair of slots being oriented substantially perpendicular to the first pair of slots; and an elongate handle having a reduced-thickness portion at a first end thereof, the first end of the handle being coupled to the coupling shaft member of the head so as to be selectively positioned in five discreet positions including (a) one wherein the axis of the handle is perpendicular to a plane defined by the top surface of the head, and (b) second through fifth positions wherein the reduced-thickness portion of the handle is engaged in a respective one of the slots in the head and in which positions the handle is oriented substantially parallel to the plane of the head top surface.

* * * * *